United States Patent [19]

Ohtaki et al.

[11] Patent Number: 4,651,699

[45] Date of Patent: Mar. 24, 1987

[54] AIR-FUEL RATIO CONTROL SYSTEM

[75] Inventors: Kiyoshi Ohtaki, Fuchu; Kazuo Hara, Musashino, both of Japan

[73] Assignee: Fuji Jukogyo Kabushiki Kaisha, Tokyo, Japan

[21] Appl. No.: 787,414

[22] Filed: Oct. 15, 1985

[30] Foreign Application Priority Data

Oct. 22, 1984 [JP] Japan ..... 59-222629

[51] Int. Cl.[4] ..... F02M 41/00; F02M 7/00

[52] U.S. Cl. ..... 123/438; 123/440; 123/480; 123/492; 123/493

[58] Field of Search ..... 123/438, 440, 492, 493, 123/480

[56] References Cited

U.S. PATENT DOCUMENTS

| | | | |
|---|---|---|---|
| Re. 29,741 | 8/1978 | Norimatsu et al. | 364/431 |
| 3,949,551 | 4/1976 | Eichler | 60/274 |
| 4,046,118 | 9/1977 | Aono | 123/438 |
| 4,089,313 | 5/1978 | Asano et al. | 123/438 |
| 4,109,615 | 8/1978 | Asano | 123/32 |
| 4,365,603 | 12/1982 | Shikata et al. | 123/440 |
| 4,376,369 | 3/1983 | Horikoshi et al. | 123/440 |
| 4,380,984 | 4/1983 | Nagai et al. | 123/440 |
| 4,385,608 | 5/1983 | Ohgami et al. | 123/440 |
| 4,399,792 | 8/1983 | Otsuka et al. | 123/440 |
| 4,419,975 | 12/1983 | Kubota et al. | 123/440 |
| 4,470,395 | 9/1984 | Ohgami et al. | 123/440 |

*Primary Examiner*—Raymond A. Nelli

*Attorney, Agent, or Firm*—Martin A. Farber

[57] ABSTRACT

An air-fuel ratio control system for an internal combustion engine has an electromagnetic valve for correcting the air-fuel ratio of air-fuel mixture, and an $O_2$ sensor for detecting oxygen concentration in exhaust gases. A detecting circuit is provided for producing an acceleration signal when the engine is accelerated at cold engine operation. A pulse generating circuit is provided for producing a plurality of pulses, the duty ratios of which are proper for air-fuel ratio at acceleration in cold engine operation. A changeover switch is provided to respond to the acceleration signal for applying the pulses to the electromagnetic valve so as to control the air-fuel ratio.

6 Claims, 4 Drawing Figures

AIR-FUEL RATIO CONTROL SYSTEM

BACKGROUND OF THE INVENTION

The present invention relates to an air-fuel ratio control system for an internal combustion engine, which system controls the air-fuel mixture to the stoichiometric air-fuel ratio, at which ratio a three-way catalyst acts most effectively.

In a known air-fuel ratio control system for a motor vehicle, the air-fuel ratio of the air-fuel mixture burned in the engine cylinders is detected as the oxygen concentration in the exhaust gases by means of an $O_2$ sensor provided in the exhaust system of the engine, and a decision is made dependent on the output signal from the $O_2$ sensor which indicates whether the air-fuel ratio is richer or leaner than the value corresponding to the stoichiometric air-fuel ratio, for producing a control signal. The control system is provided with a basic pulse generating section for generating basic pulses, and a calculating section which operates to correct the duty ratio of the basic pulses in accordance with the control signal so as to meet driving conditions. The pulses operate an electromagnetic valve so as to control the amount of bleed air in a carburetor for controlling the air-fuel ratio of the mixture. When the duty ratio of the pulses is reduced, the air-fuel mixture is enriched. Thus, the air-fuel ratio is controlled to the stoichiometric air-fuel ratio, at which a three-way catalyst in the exhaust system acts most effectively.

In such an air-fuel ratio control system at cold engine operation, the air-fuel ratio is controlled by open loop control with fixed duty ratios stored in a look-up table. However, the look-up table can not be provided so as to supply an air-fuel mixture having a duty ratio which satisfies both conditions of steady state driving and transient state driving such as acceleration. Although the amount of intake air increases, when the engine is accelerated, the amount of induced fuel does not increase with an increase of the intake air. Accordingly, the air-fuel mixture must be enriched upon acceleration. If the table is made to meet the transient state, the air-fuel ratio is improper for the steady state.

SUMMARY OF THE INVENTION

Accordingly, the object of the present invention is to provide a system which may effectively control the air-fuel ratio at acceleration of an engine during cold engine operation.

Other objects and features of this invention will become understood from the following description with reference to the accompanying drawings.

DETAILED DESCRIPTION OF THE PREFERRED EMBODIMENT

Figure 1:
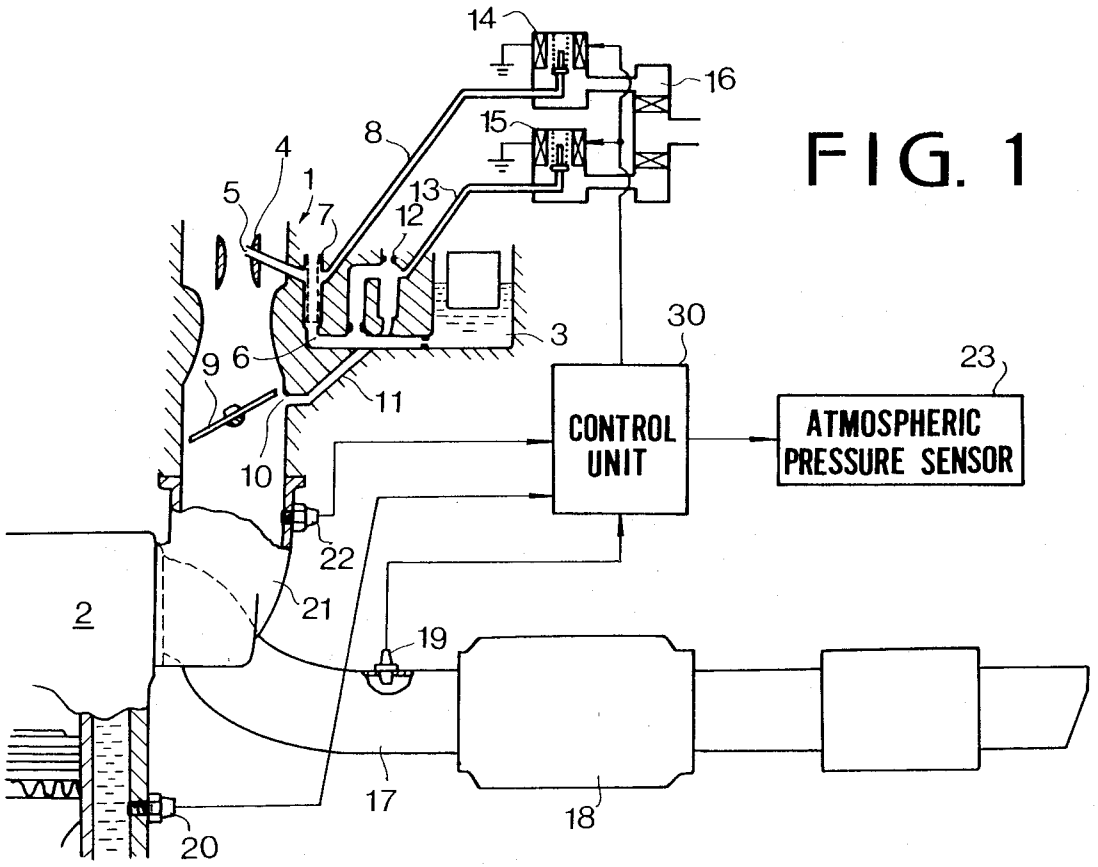
FIG. 1 is a schematic explanatory view of an air-fuel ratio control system according to the present invention.

Referring to FIG. 1, a carburetor 1 is provided adjacent to an intake manifold (induction passage) 21 of an internal combustion engine 2. A correcting air passage 8 communicates with an air-bleed 7 which is provided in a main fuel passage 6 between a float chamber 3 and a nozzle 5 in a venturi 4. Another correcting air passage 13 communicates with another air-bleed 12 which is provided in an idle fuel passage 11 which diverges from the main fuel passage 6 and extends to an idle port 10 in the vicinity of a throttle valve 9. These correcting air passages 8 and 13 communicate with on-off type electromagnetic valves 14, 15, the induction sides of which are in communication with the atmosphere through an air filter 16. A three-way catalytic converter 18 is provided in an exhaust pipe 17 downstream of the engine, and an $O_2$ sensor 19 is provided between the engine 2 and the converter 18 to detect the oxygen concentration of exhaust gases when the air-fuel mixture is burned in the engine. A coolant temperature sensor 20 is provided on a water jacket of the engine for detecting the temperature of cooling water and a vacuum sensor 22 is provided in the intake manifold 21 downstream of the throttle valve 9, and an atmospheric pressure sensor 23 is provided in the system to detect pressure for correcting the air-fuel ratio.

The outputs of the $O_2$ sensor 19, coolant temperature sensor 20, vacuum sensor 22, and the atmospheric pressure sensor 23 are sent to a control unit 30 which produces an output signal to actuate the electromagnetic valves 14, 15 to open and close them at a duty ratio. Thus, either considerable air is supplied to the fuel system through the air correcting passages 8, 13 to produce a lean air-fuel mixture or only a small amount of air is supplied to the system so as to enrich the air-fuel mixture.

Figure 2:
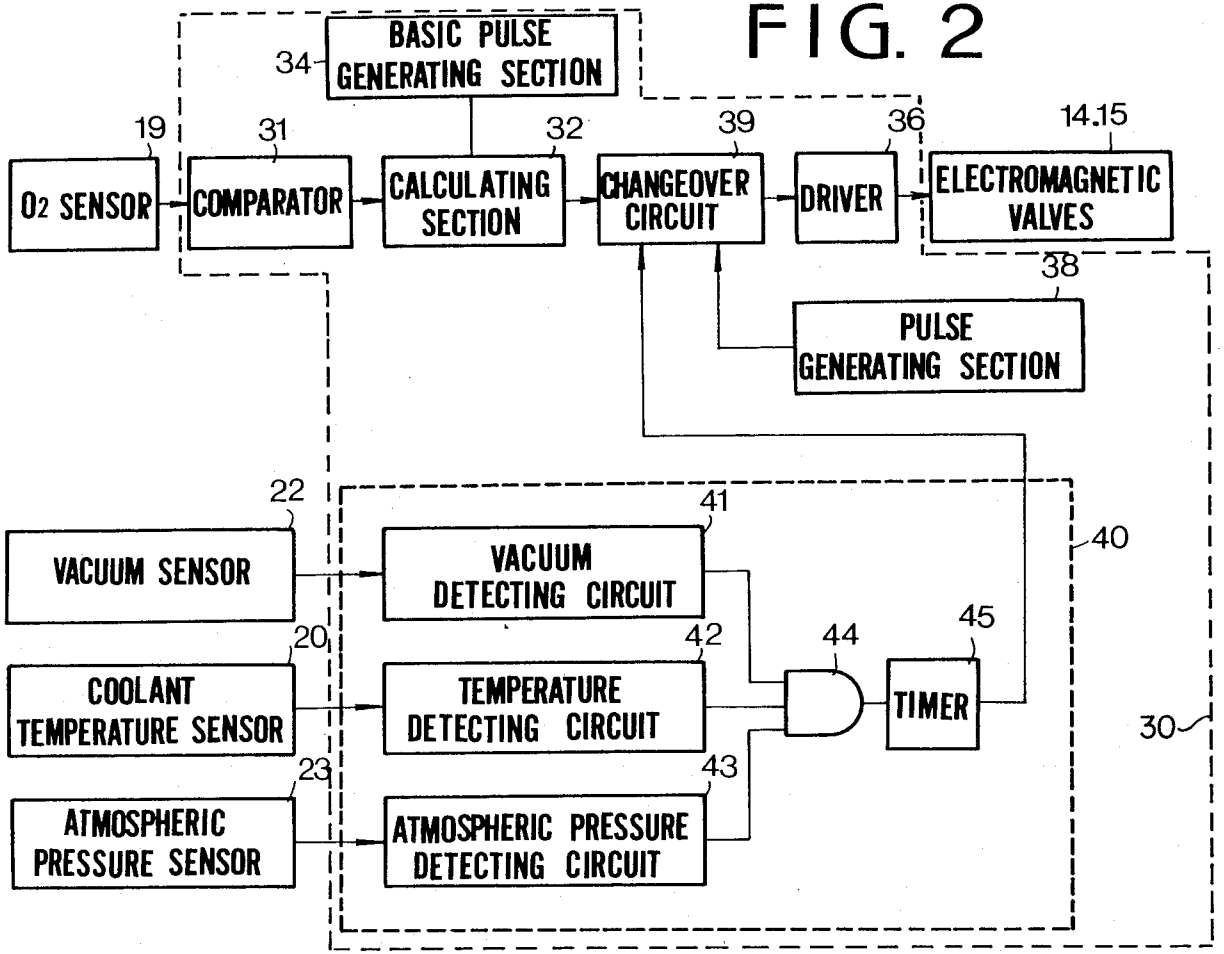
FIG. 2 shows a block diagram of the electric control circuit of the present invention.

FIG. 2 shows the construction of the control unit 30 which includes a feedback control circuit (31, 32, 34, 39, 36). The control unit is provided with a basic pulse generating section 34 for producing basic pulses having a constant duty ratio, which are sent to a calculating section 32. The output of the $O_2$ sensor 19 is applied to the calculating section 32 through a comparator 31.

Generally, the air-fuel ratio varies cyclically with respect to the stoichiometric air-fuel ratio. Accordingly, the output of the $O_2$ sensor 19 has a waveform having a wavelength. The output is compared with a reference value at the comparator 31 which produces error signal pulses dependent on the waveform. The pulses are applied to the calculating section 32, where the basic pulses supplied from the section 34 is corrected by the error signal pulses to generate controlled or corrected output pulses, the duty ratio of which is corrected to correct the deviation of the air-fuel ratio. The controlled output pulses are supplied to the electromagnetic valves 14, 15 via a changeover circuit 39 and a driver 36 for operating the valves.

When a rich air-fuel mixture is detected, the calculating section 32 produces pulses having a large duty ratio so as to dilute the mixture. At a lean air-fuel mixture, the calculating section produces pulses having a small duty ratio so as to enrich the mixture.

A fixed duty ratio pulse generating section 38 is provided for providing various pulses in accordance with driving conditions.

Figure 3:
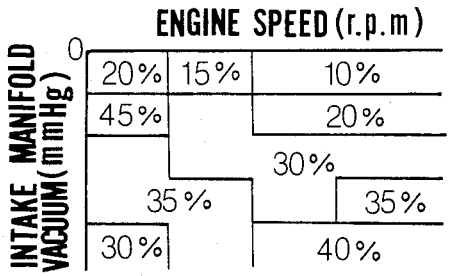
FIG. 3 shows a look-up table for air-fuel ratio.

The section 38 has a look-up table as shown in FIG. 3. The table is a three-dimensional table for producing a duty ratio signal dependent on an intake manifold vacuum signal by the output of the vacuum sensor 22 and on an engine speed signal which is obtained by ignition pulses. The table is made to provide various duty ratios which are proper for conditions of the engine during cold engine operation. The fixed duty ratio pulse generating section 38 is adapted to produce a plurality of pulse trains, each train having a fixed duty ratio which is determined by the look-up table in accordance with intake manifold vacuum (load on the engine) and engine speed. The fixed duty ratio pulses are applied to the electromagnetic valves 14 and 15 through the changeover circuit 39 and driver 36.

The changeover circuit 39 is operated by an output of a detecting circuit 40. The circuit 40 comprises an intake manifold vacuum detecting circuit 41 (comprising an acceleration detecting circuit), a coolant temperature detecting circuit 42 and an atmospheric pressure detecting circuit 43. The vacuum detecting circuit 41 is supplied with the output of the vacuum sensor 22 and produces a high level output when the vacuum (a value close to atmospheric pressure) is lower than a predetermined value (for example −300 mmHg), which means that the engine is greatly accelerated.

The coolant temperature detecting circuit 42 is applied with a signal from the coolant temperature sensor 20 and produces a high level output when the temperature is below 80° C. The atmospheric pressure detecting circuit 43 produces a high level output when the atmospheric pressure sensed by an atmospheric pressure sensor 23 is higher than 650 mmHg. The outputs of the circuits 41, 42 and 43 are applied to an AND gate 44, a high level output of which is applied to a timer 45 to operate it. The timer 45 produces a high level output for 0.2 seconds. Even if the high level output of the AND gate continues more than 0.2 seconds, the output of the timer 45 becomes low after 0.2 seconds. The high level output of the timer 45 operates the changeover circuit 39 to cut off the input from the calculating section 32 and to connect the output of the circuit 38 to the driver 36.

In cold engine operation at low altitude, when the manifold vacuum is higher than −300 mmHg. in a driving condition such as idling operation of the engine or steady state driving, the vacuum detecting circuit 41 produces a low level output, causing the output of AND gate 44 to go to a low level. Accordingly, the output of timer 45 is at a low level, so that the changeover circuit 39 connects the output of the calculating section 32 to the driver 36. Thus, the air-fuel ratio is controlled by the feedback control system.

Figure 4:
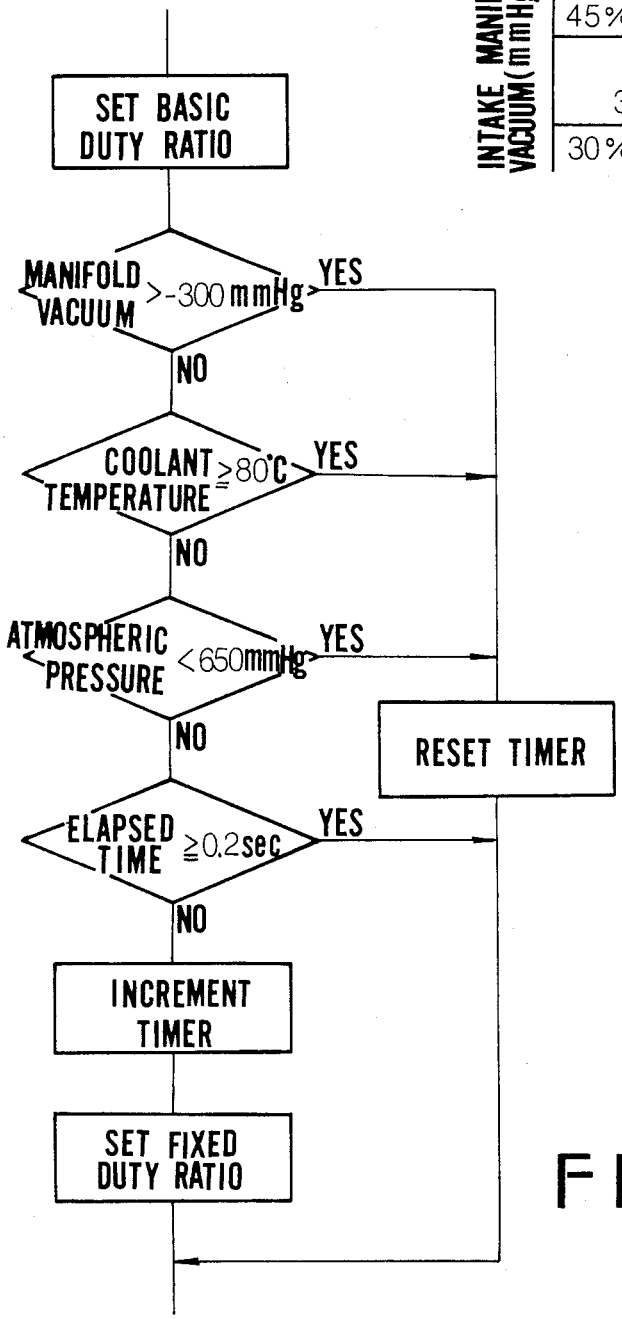
FIG. 4 shows a flowchart showing the operation of the system.

When the manifold vacuum becomes lower than −300 mmHg by acceleration of the engine at cold engine operation at low altitude, the output of AND gate 44 goes to a high level, so that the output of timer 45 becomes high for 0.2 seconds at the most. Thus, during this period, pulses having duty ratios determined by the look-up table in accordance with the manifold vacuum and engine speed are applied from the section 38 to the electromagnetic valves 14 and 15 through the changeover circuit 39 and driver 36. Accordingly, the air-fuel ratio is controlled so as to meet the requirements at acceleration in cold engine operation. When one of inputs of AND gate 44 changes at a level, or after 0.2 seconds lapse, the output of the timer 45 goes to a low level. Thus, the system returns to the feedback control system. FIG. 4 shows the above described operation of the system.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. In an air-fuel ratio control system for an internal combustion engine having an induction passage, means for supplying air-fuel mixture to the engine, an electromagnetic valve for correcting the air-fuel ratio of the air-fuel mixture supplied by the supplying means, an $O_2$ sensor for detecting oxygen concentration in exhaust gases of the engine, and a feedback control circuit including comparator means for comparing the output of the $O_2$ sensor with a reference value for producing an output signal responsive to the comparison, means for generating basic pulses having a constant duty ratio, calculating means responsive to the output signal of the comparator means for correcting the basic pulses such that a duty ratio thereof is dependent on the output signal, the corrected pulses being for driving the electromagnetic valve to correct the air-fuel ratio, and a vacuum sensor sensing the pressure in the induction passage, the improvement comprising:

pulse generating means for storing a plurality of pulse trains which have different duty ratios dependent on the pressure in the induction passage and engine speed;

vacuum detecting means for producing a first signal upon acceleration of the engine;

coolant temperature detecting means for producing a second signal at cold engine operation;

gate means responsive to the first and second signals for producing a third signal;

a timer responsive to the fourth signal for producing a fifth signal for a predetermined time; and switching means responsive to the fourth signal for supplying one of the pulse trains stored by the pulse generating means, corresponding to prevailing engine speed and pressure in the induction passage, to the electromagnetic valve and operatively cutting off the pulses from the calculating means.

2. In an air-fuel ratio control system for an internal combustion engine having an induction passage, closed loop feedback control means for continuously correcting the air-fuel ratio of the air-fuel mixture supplied by the supplying means, comprising an $O_2$ sensor for detecting oxygen concentration in exhaust gases of the engine, a feedback control circuit including comparator means for comparing the output of the $O_2$ sensor with a reference value for producing an output signal responsive to the comparison, means for correcting the air-fuel ratio dependent on the output signal when said closed loop feedback control means is operative, the improvement comprising:

means for storing as a map a plurality of different second output signals dependent on engine acceleration and engine speed; and means responsive to acceleration of the engine at cold engine operation for supplying a respective one of said second output signals stored by the storing means, corresponding to prevailing engine speed and engine acceleration, to the correcting means and operatively disconnecting the closed loop feedback control means, said correcting means for correcting the air-fuel ratio dependent on said respective one of said second output signals when said closed loop feedback control means is operatively disconnected.

3. In an air-fuel ratio control system for an internal combustion engine having an induction passage, means for supplying air-fuel mixture to the engine, an electromagnetic valve for correcting the air-fuel ratio of the air-fuel mixture supplied by the supplying means, an $O_2$ sensor for detecting oxygen concentration in exhaust gases of the engine, and a feedback control circuit including comparator means for comparing the output of the $O_2$ sensor with a reference value for producing an output signal responsive to the comparison, means for generating basic pulses having a constant duty ratio, calculating means responsive to the output signal of the comparator means for correcting the basic pulses such that a duty ratio thereof is dependent on the output signal, the corrected pulses being for driving the electromagnetic valve to correct the air-fuel ratio, and a vacuum sensor sensing the pressure in the induction passage, the improvement comprising:

pulse generating means for storing a plurality of pulse trains which have different duty ratios dependent on the pressure in the induction passage and engine speed;

vacuum detecting means for producing a first signal upon acceleration of the engine;

coolant temperature detecting means for producing a second signal at cold engine operation;

atmospheric pressure detecting means for producing a third signal at low altitude;

gate means responsive to the first, second and thrid signals for producing a fourth signal;

a timer responsive to the fourth signal for producing a fifth signal for a predetermined time; and switching mean responsive to the fifth signal for supplying one of the pulse trains stored by the pulse generating means, corresponding to the prevailing engine speed and pressure in the induction passage, to the electromagnetic valve and operatively cutting off the pulses from the calculating means.

4. The air-fuel ratio control system according to claim 1 further comprising atmospheric pressure detecting means for producing a signal at low altitude, the signal being applied to the gate means as an input for operating the gate means.

5. The system according to claim 3, wherein said timer is responsive to absence of said fourth signal for terminating said fifth signal.

6. The system according to claim 1, wherein said timer is responsive to absence of said third signal for terminating said fourth signal.

* * * * *